US011851925B2

(12) United States Patent
Bogdanov et al.

(10) Patent No.: US 11,851,925 B2
(45) Date of Patent: Dec. 26, 2023

(54) KEY OVERRIDE FOR ELECTROMECHANICAL MULTI-POINT LATCHING DEVICE

(71) Applicant: Sargent Manufacturing Company, New Haven, CT (US)

(72) Inventors: Victor Bogdanov, Manchester, CT (US); Liza Alcala Escobar, Avon, CT (US)

(73) Assignee: Sargent Manufacturing Company, New Haven, CT (US)

( * ) Notice: Subject to any disclaimer, the term of this patent is extended or adjusted under 35 U.S.C. 154(b) by 420 days.

(21) Appl. No.: 16/803,003

(22) Filed: Feb. 27, 2020

(65) Prior Publication Data

US 2020/0270918 A1 Aug. 27, 2020

Related U.S. Application Data

(60) Provisional application No. 62/811,360, filed on Feb. 27, 2019.

(51) Int. Cl.

| | |
|---|---|
| ***E05C 9/04*** | (2006.01) |
| ***E05B 63/14*** | (2006.01) |
| ***E05B 47/06*** | (2006.01) |
| ***E05B 63/08*** | (2006.01) |

(52) U.S. Cl.

CPC ..... *E05C 9/047* (2013.01); *E05B 47/0615* (2013.01); *E05B 63/14* (2013.01); *E05B 63/08* (2013.01)

(58) Field of Classification Search

CPC ..... E05C 9/047; E05B 47/0615; E05B 63/14; E05B 63/08; Y10T 292/0836; Y10T 292/0837; Y10T 292/0839; Y10T 292/096; Y10T 292/0961; Y10T 292/0962; Y10T 292/0963; Y10T 292/0967

See application file for complete search history.

(56) References Cited

U.S. PATENT DOCUMENTS 3,148,525 A * 9/1964 Durant ..... E05B 47/026 70/280
3,672,714 A * 6/1972 Schultz ..... E05B 59/00 292/336.5
3,769,822 A * 11/1973 Yulkowski ..... E05B 59/00 70/486

(Continued)

FOREIGN PATENT DOCUMENTS

CA 2879422 A1 2/2014
EP 1203860 A1 * 5/2002 ..... E05B 63/20

(Continued)

*Primary Examiner* — Christine M Mills
*Assistant Examiner* — Faria F Ahmad
(74) *Attorney, Agent, or Firm* — Wolf, Greenfield & Sacks, P.C.

(57) ABSTRACT

A multi-point latching device may include a mortise lock and one or more remote latches which are operable with a handle. The mortise lock may include a handle lock which selectively locks and unlocks the handle is independently controllable by an actuator and by a lock cylinder. The lock cylinder may be used to unlock the handle during power failure events where the mortise lock is put into a fail secure state, such that the mortise lock maintains normal functionality as a manual device.

12 Claims, 7 Drawing Sheets

(56) References Cited

U.S. PATENT DOCUMENTS 4,037,440 A * 7/1977 Shabtai ..... E05C 9/06 70/120
4,453,753 A * 6/1984 Fayerman ..... E05B 65/104 292/357
4,674,776 A * 6/1987 James ..... E05B 59/00 292/150
4,988,133 A * 1/1991 Shih ..... E05B 63/044 292/191
5,678,870 A * 10/1997 Pelletier ..... E05B 55/12 292/169.16
6,145,353 A * 11/2000 Doucet ..... E05B 47/0692 70/277
6,174,004 B1 * 1/2001 Picard ..... E05B 65/1046 292/341.15
6,282,929 B1 * 9/2001 Eller ..... E05C 9/02 70/109
6,354,121 B1 * 3/2002 Frolov ..... E05B 47/0692 292/164
6,539,755 B1 * 4/2003 Bruwer ..... E05B 47/0012 70/279.1
6,622,535 B2 * 9/2003 Chiang ..... E05B 47/0692 70/277
6,732,557 B1 * 5/2004 Zehrung ..... E05B 47/0607 70/462
7,188,870 B2 * 3/2007 Huang ..... E05B 15/10 70/462
8,671,724 B2 * 3/2014 Uyeda ..... E05B 55/00 70/108
9,133,650 B1 * 9/2015 Luca ..... E05B 17/0025
9,617,757 B2 * 4/2017 Lowder ..... G07C 9/00658
9,631,400 B2 * 4/2017 Liu ..... E05B 13/101
10,570,645 B2 * 2/2020 Ellis ..... E05C 1/08
10,907,381 B2 * 2/2021 Lien ..... E05B 47/0692
11,111,698 B2 * 9/2021 Mitchell ..... E05C 7/06
11,156,021 B2 * 10/2021 Guma ..... E05B 9/02
2006/0080912 A1 * 4/2006 Shedd ..... E05B 65/0876 52/204.1
2006/0087125 A1 * 4/2006 Moon ..... E05B 63/20 292/32
2007/0245784 A1 * 10/2007 Geringer ..... E05B 47/0669 70/277
2010/0327610 A1 * 12/2010 Nakanishi ..... E05B 17/2038 292/157
2011/0203331 A1 * 8/2011 Picard ..... E05B 47/00 29/829
2012/0139266 A1 * 6/2012 Chen ..... E05B 63/20 292/8
2012/0326456 A1 * 12/2012 Picard ..... H05K 13/00 361/752
2013/0298617 A1 * 11/2013 Lambrou ..... E05B 47/0673 70/279.1
2014/0042757 A1 * 2/2014 Chen ..... E05B 13/005 292/341.15
2015/0184425 A1 * 7/2015 Ellis ..... E05B 47/0673 292/144
2016/0145904 A1 * 5/2016 Lowder ..... E05B 47/0001 292/145
2017/0138087 A1 * 5/2017 Chen ..... E05B 59/00
2018/0010367 A1 * 1/2018 Maeng ..... E05B 47/0012
2018/0112438 A1 * 4/2018 Guma ..... E05B 9/02
2021/0054663 A1 * 2/2021 Cheng ..... E05B 63/12

FOREIGN PATENT DOCUMENTS

GB 2 301 142 A 11/1996
GB 2 564 225 A 1/2019

* cited by examiner

KEY OVERRIDE FOR ELECTROMECHANICAL MULTI-POINT LATCHING DEVICE

RELATED APPLICATIONS

This application claims the benefit under 35 U.S.C. § 119(e) to U.S. Provisional Application Ser. No. 62/811,360, entitled "Key Override For Electromechanical Multi-Point Latching Device", filed on Feb. 27, 2019, which is herein incorporated by reference in its entirety.

FIELD

Disclosed embodiments are related to key overrides for electromechanical multi-point latching devices and related methods of use.

BACKGROUND

Multi-point latching devices are commonly used in environments where high security or sever weather resistance is required. For example, many multi-point latches are used in FEMA rated applications such as hurricane and tornado shelters. In some cases, multi-point latching devices are electrified so that various features of the latching device may be controlled electromechanically.

SUMMARY

In some embodiments, a latching device includes a chassis, a latch bolt configured to move between a latch extended position and a latch retracted position, a handle lock configured to selectively lock a handle in a locked position and unlock a handle in an unlocked position, an electromechanical actuator configured to move the handle lock between the locked and unlocked position, and a lock cylinder configured to receive a key. The lock cylinder is further configured to rotate. When the lock cylinder is rotated in a first direction the latch bolt is moved from the latch extended position to the latch retracted position, and the handle lock is moved from the locked position to the unlocked position. In some embodiments, he latching device also includes a handle and at least one rod actuated latch coupled to the handle, where when the handle is rotated the at least one rod actuated latch moves from a rod actuated extended position to a rod actuated retracted position. The handle lock is configured to prevent rotation of the handle in the locked position and permit rotation of the handle in the unlocked position.

In some embodiments, a method of operating a multi-point latching device includes moving a handle lock between a locked position and an unlocked position with an electromechanical actuator, rotating a lock cylinder in a first direction to move a latch bolt from a latch extended position to a latch retracted position, and rotating the lock cylinder in the first direction to move the handle lock from a locked position to an unlocked position.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures. s

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
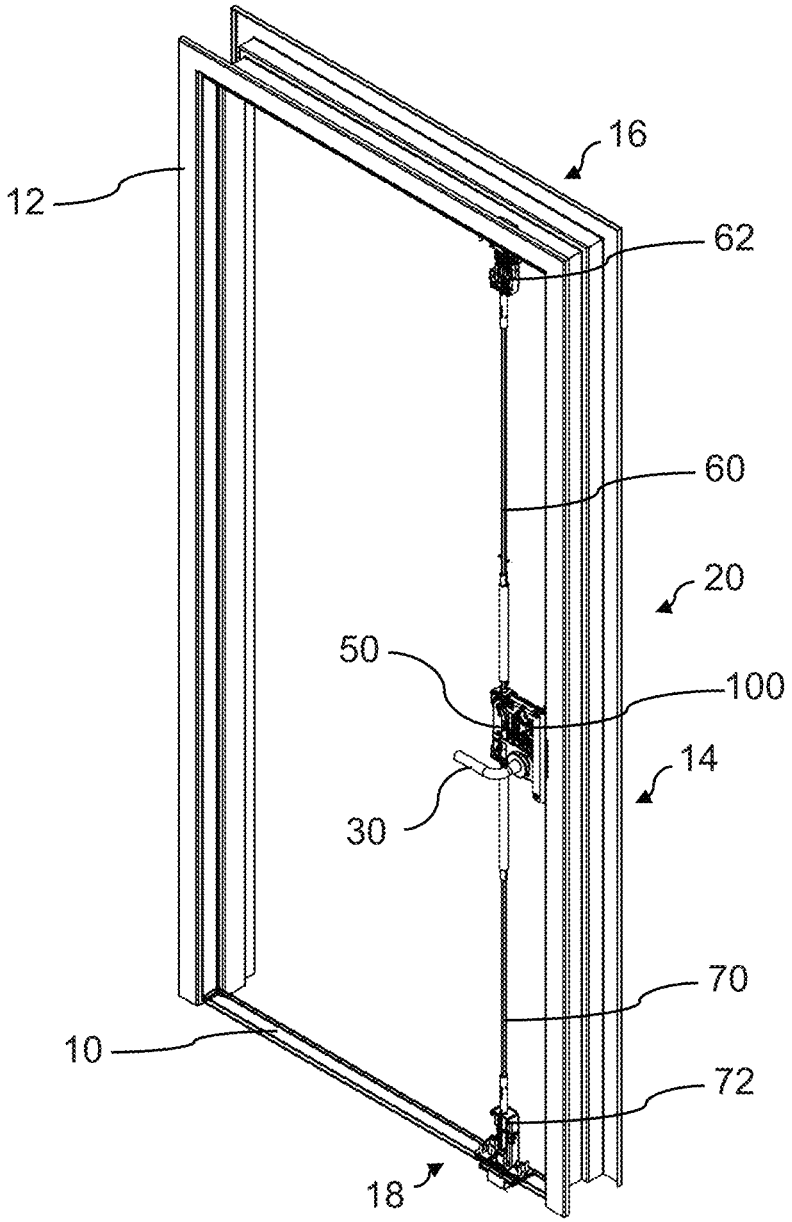
FIG. 1 is a perspective view of a door including a multi-point latching device.

Conventional multi-point latching devices are commonly employed in high security areas or in access points which may be susceptible to hazardous or severe weather such as hurricanes and tornados. These conventional multi-point latching devices generally employ three distinct latches and also include a deadbolt to improve security. Some multi-point latches include a handle which may be selectively locked or unlocked (i.e., rotation of the handle is selectively prevented or allowed). The handle is generally linked to actuation of the distinct latches, where rotating the handle retracts the distinct latches to allow an operator to open a door secured by the multi-point latching devices. In some cases, is it desirable to electronically control the locked state of the handle to simplify operation for a local operator (e.g. with card reader access, biometrics, etc.) or for a remote operator (e.g., using a central controller, remote computer, or mobile device). However, in cases of power loss, such electromechanical multi-point latching devices may become inoperable with the handle remaining unchangeable in a locked or unlocked state. That is, an electromechanical multi-point latching device may fail secure with the handle in a locked state or may fail safe with the handle in the unlocked state. In either case, with conventional multi-point latching devices the state of the handle lock is not changeable manually, such that power needs to be restored before the state of the handle may be changed. Thus, the inventors have found that it may be desirable to provide a manual override which may change the state of a handle when an electronically controlled latching device is unpowered.

In view of the above, the inventors have recognized the benefits of a manual override such as a key operated lock cylinder which is usable to override one or more electronically controlled components of a multi-point latching device. The manual override may allow a handle lock to be moved from a locked position to an unlocked position to unlock a door handle when the multi-point latching device is in a fail safe power state. Such an arrangement may allow an electronically controlled multi-point latching system to remain secure in power loss states while still being operable to authorized operators without interference of the electromechanical components of the multi-point latching device.

In some cases, a multi-point latching device may be modular or semi-modular to improve ease of installation and allow for a variety of features to be selected by an end user. Additionally, such modularity allows components to be shared across multiple lines of locking devices. In some embodiments, a multi-point latching device includes a mortise lock and a cassette controlling one or more rod actuated latches. The mortise lock may perform latching and bolting of a door along a door jamb and may also provide an interface for an operator to use the multi-point latching device. The cassette may cooperate with the mortise lock to enable a handle associated with the mortise lock to actuate one or more rod actuated latches such as a transom latch or bottom latch when operated. Thus, the mortise lock may be used alone to secure a door, or may be complemented with the cassette to enable multi-point latching. The mortise lock may include a deadbolt, latch bolt, lock cylinder, handle lock, and handle lock actuator. The deadbolt and latch bolt may be operated by the lock cylinder and a handle, respectively, to selectively secure or unsecure a door. The handle lock is movable between a locked position where at least one side of the handle (e.g., an exterior side of the handle) is secured and an unlocked positon where the handle is free to rotate to move the latch bolt. The handle lock actuator may be used to electronically move the handle lock between the locked and unlocked positions. In some embodiments, the lock cylinder may be rotated to move the handle lock from a locked position to an unlocked position to override the control of the handle lock by the handle lock actuator (e.g., in power failure scenarios). When the handle is unlocked, it may be turned to operate a cassette and retract the one or more rod actuated latches so an associated door may be opened. Accordingly, the multi-point latching device may switch from an electronically controlled device to a manually controlled device during power failure without any loss of security or mechanical functionality.

In some embodiments, a method of operating a mechanical override for a multi-point latching device may be simple and easy to allow an operator to unlock and open a secure door during a power failure. Starting with a multi-point latching device fully secured (i.e., a deadbolt is extended, a latch bolt is extended, and one or more rod actuated latches are extended), the method may include rotating a lock cylinder with a key to retract the deadbolt. Retracting the deadbolt may include rotating the lock cylinder a full rotation (i.e., 360 degrees) to fully retract the deadbolt and reset the lock cylinder. The method may also include continuing to rotate the lock cylinder to retract the latch bolt. Retracting the latch bolt may use less rotation, and the rotation may be against a biasing force of the latch bolt. As the latch bolt is retracted, a handle lock may also be moved from a locked position to an unlocked position so that a handle may be rotated. The method may include holding the lock cylinder to resist the biasing force while the handle lock is in an unlocked position, and rotating (i.e., actuating) the handle to retract the one or more rod actuated latches). Once the handle is turned, each of the latches and bolts of the multi-point latching device may be retracted so that the door may be opened. Thus, rotating a lock cylinder in a single direction may be used to unlock a locked handle and reliably operate an electromechanical multi-point latching device without power.

In some embodiments, a mortise lock may include a deadbolt that cooperates with a latch bolt and an auxiliary bolt to control movement of the deadbolt between a deadbolt retracted position and deadbolt extended position. The deadbolt may also include a slide mechanism arranged to allow a turning motion of a deadbolt handle to extend or retract the deadbolt. The slide mechanism may also be configured to prevent the retraction of the deadbolt without a corresponding turning of the deadbolt handle. In some embodiments, the deadbolt may be configured to be actuated by a door handle coupled to the latch bolt, such that the door can be operated traditionally by a single handle.

In some embodiments, a mortise lock may include a latch bolt that cooperates with the deadbolt and the auxiliary bolt to control movement of the latch bolt between a latch extended position and a latch retracted position. The latch bolt may include a latch bolt head with an inclined face constructed and arranged to strike a door frame as the door is closed, thereby causing the latch bolt to be retracted. The latch bolt may further include a latch biasing member arranged to urge the latch bolt toward the latch extended latch position. In some embodiments, the latch bolt may include an end constructed and arranged to actuate the deadbolt to a retracted position when a door handle coupled to the end of the latch bolt is turned. According to this embodiment, the movement of the latch bolt head may be decoupled from the movement of the end that actuates the deadbolt, thereby preventing retraction of the deadbolt from external force applied on the latch bolt head. In some embodiments, the latch bolt head may be prevented from retracting with the deadbolt is in the extended position (i.e., deadlocking) or the auxiliary bolt is in the retracted position.

In some embodiments, a mortise lock may include an auxiliary bolt that cooperates with the deadbolt and the latch bolt to control movement of the latch bolt between a latch extended position and a latch retracted position. The auxiliary bolt may be connected to an auxiliary biasing member that urges the auxiliary bolt to an extended auxiliary position. The auxiliary bolt may further include an auxiliary bolt head with an inclined face configured to retract the auxiliary bolt when the auxiliary bolt head strikes a door frame. The auxiliary bolt may include one or more tabs located on an auxiliary arm arranged to contact a guard lever. In some embodiments, the guard lever is moveable by the auxiliary bolt and includes a blocking end configured to abut the latch bolt and prevent retraction through any external forces applied to the latch bolt head. Such an arrangement may improve security and resistance of the mortise lock to shimming.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

FIG. 1 is a perspective view of a door 10 including a multi-point latching device 20 installed in the door. As shown in FIG. 1, the door 10 is mounted in a door frame 12 which would be securely mounted in a wall of a structure. The multi-point latching device is configured to selectively secure the door to the door frame at three separate regions to provide excellent security and resistance to external forces such as windborne debris and wind pressure. In particular, the multi-point latching device is configured to secure the door at a jamb region 14, transom region 16, and bottom region 18. That is, the multi-point latching device includes a mortise lock 100 and a cassette 50 (see also FIG. 2) which cooperate to control a top latch 62, bottom latch 72, and latch bolt (for example, see FIG. 4) which engage the jamb region, transom region, and bottom region, respectively. According to the embodiment of FIGS. 1 and 2, the cassette is configured to fit around the mortise lock 100 and convert the action of a handle 30 which may operate the latch bolt of the mortise lock into vertical motion suitable to operate the top latch and bottom latch. That is, the cassette converts rotary motion of the handle 30 into vertical motion of a first vertical rod 60 coupled to the top latch and a second vertical rod 70 coupled to the bottom latch. The reciprocal motion of the first and second vertical rods moves the top latch and bottom latch between extended positions and retracted positions concurrently with the latch bolt of the mortise lock. Of course, while a latch bolt, top latch, and bottom latch are shown in FIG. 1, any suitable number of latches may be used to secure the door in any region of the door frame to reliably secure the door, as the present disclosure is not so limited.

Figure 2:
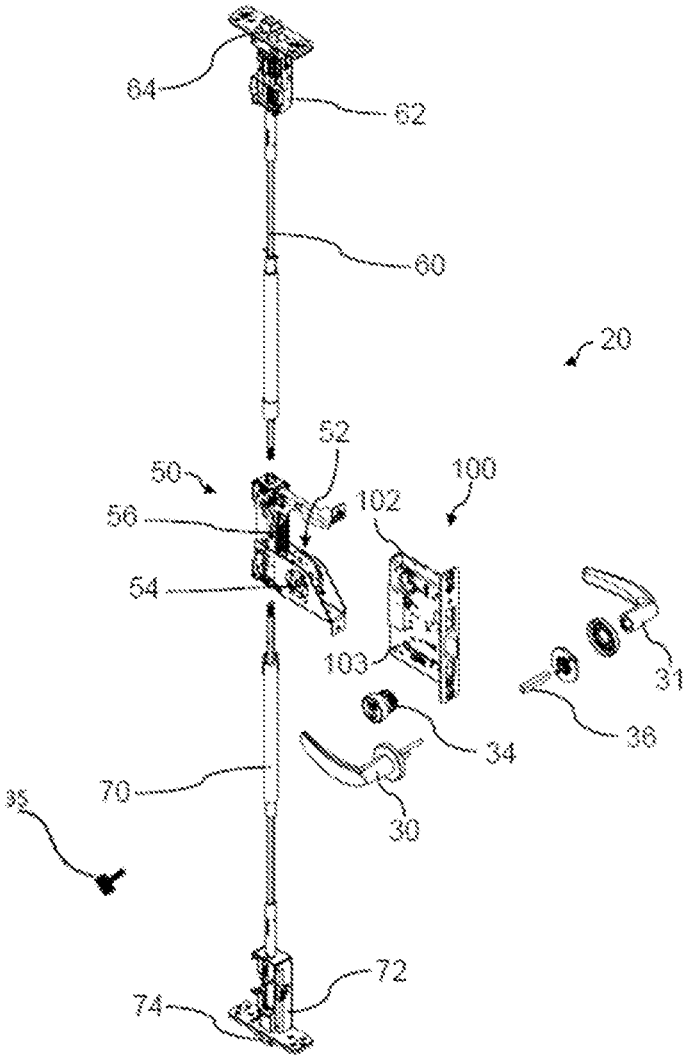
FIG. 2 is an exploded view of the multi-point latching device of FIG. 1.

FIG. 2 is an exploded view of the multi-point latching device 20 of FIG. 1 showing the various components of the multi-point latching device in detail. As noted previously, the multi-point latching device includes a mortise lock 100 and a cassette 50 which are modular components which cooperate to achieve latching of a door in multiple regions of a door frame. As shown in FIG. 2, the cassette includes a receptacle 52 configured to receive the mortise lock. In particular, the receptacle is sized and shaped to receive a housing 102 of the mortise lock. When the mortise lock is received the cassette, a handle mount 54 of the cassette may be aligned with a handle mount 103 of the mortise lock, each of which are configured to receive a handle pin 36 to which a first handle 30 and a second handle 31 are attached on opposite sides of a door. The cassette includes conversion hardware 56 which converts the rotational motion of the first handle or second handle into linear motion of the first vertical rod 60 and second vertical rod 70 (e.g., via a cam and sliding element). When the first vertical rod and second vertical rod are moved linearly, they operate the top latch 62 and bottom latch 72. That is, when the first vertical rod is reciprocated, a top latch head 64 is moved between a top latch extended position and a top latch retracted position. Likewise, when the second vertical rod is reciprocated, a bottom latch head 74 is moved between a bottom latch extended position and a bottom latch retracted position. As shown in FIG. 2, the mortise lock may also include a lock cylinder 34 which may be operated with a key 35 to retract a deadbolt, latch bolt, or lock or unlock the first handle and/or second handle if the mortise lock includes a handle lock actuator, as will be discussed further with reference to FIGS. 3-9. Of course, while a modular multi-point latching device is shown in FIGS. 1-2, any suitable multi-point latching device may be employed, including, but not limited to, devices having integrated multi-point actuators, lever based multi-point actuators for exit devices, mortise locks, bored locks, cylindrical locks, and/or tubular locks, as the present disclosure is not so limited.

Now turning to FIGS. 3-9, one embodiment of a mortise lock 100 which may be used with a multi-point latching device is shown in multiple states. This mortise lock includes an electromechanical actuator 153 which may be used to selectively secure at least one handle attached to the door lock by selectively actuating a handle lock 150 which interacts with a handle mount 162. However, in cases of power loss, the mortise lock 100 includes linkages which allow a lock cylinder 34 to be used as a manual key override to open the door while allowing the door to remain secure during power failure (i.e., fail secure). The various components of the mortise lock will be described in detail with reference to FIGS. 4-5 and this key override functionality will be described in detail with reference in particular to FIGS. 6-9.

Figure 3:
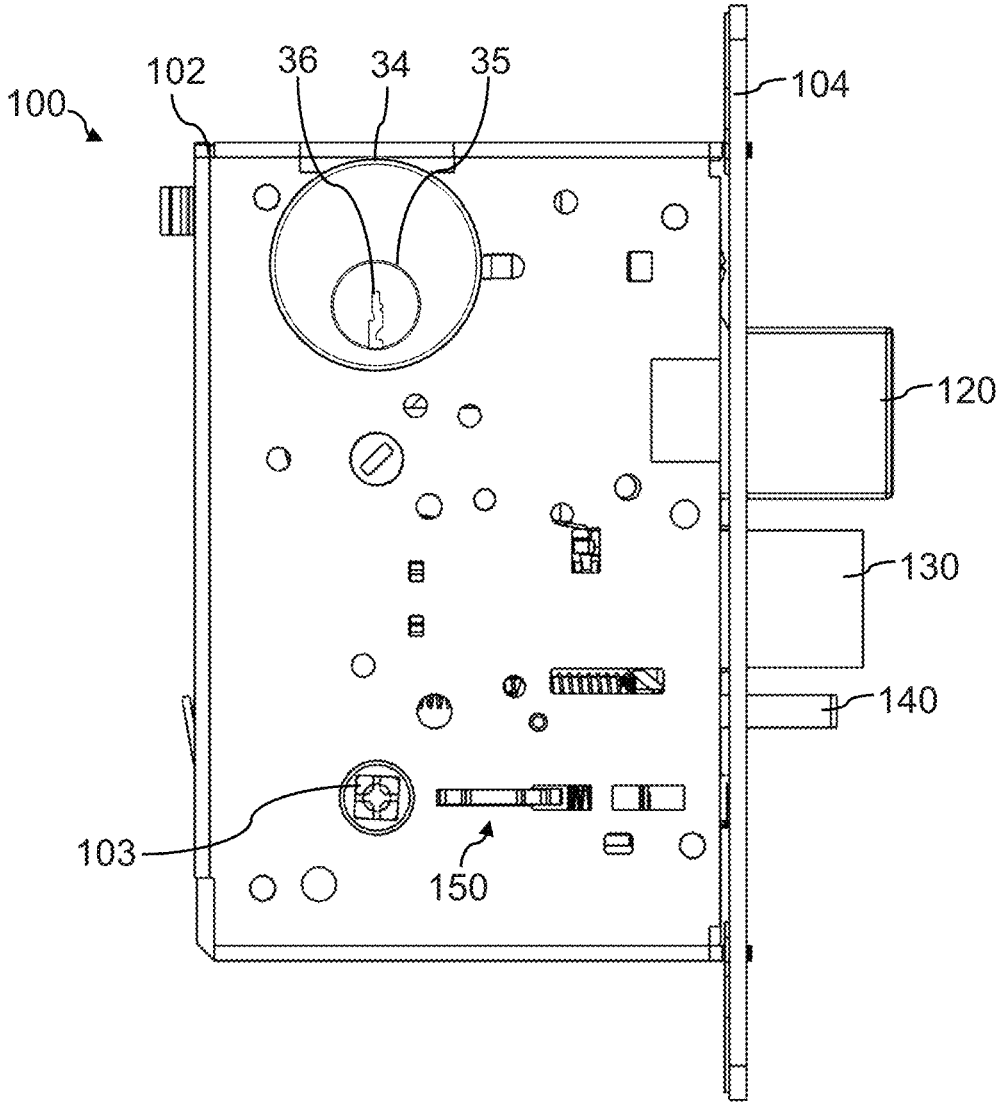
FIG. 3 is a front view of one embodiment of a mortise lock for use with a multi-point latching device.

FIG. 3 depicts one embodiment of a mortise lock 100 for a multi-point latching device which includes a lock cylinder 34 configured to allow manual, mechanical override of electromechanical features. As shown in FIG. 3, the mortise lock includes a chassis or housing 102 having a front plate 104. The mortise lock includes a deadbolt 120, latch bolt 130, and auxiliary bolt 140 which selectively project out of the front plate to secure an associate door and/or control various functions of the mortise lock. According to the embodiment of FIG. 3, the mortise lock includes a handle mount 103 for receiving an associated handle or lever which may be operable to control whether the lock is latched or unlatched and/or whether associated rod actuated latches which may be associated with a cassette (see FIG. 2) are latched or unlatched. The mortise lock 100 includes a handle lock 150 which is configured to selectively lock or unlock the handle mount to correspondingly lock or unlock the handle. As will be discussed further below, the handle lock may be operable by an electromechanical actuator during normal operation, but may be overridden with manual operation of the lock cylinder. According to the embodiment of FIG. 3, the lock cylinder includes an engagement portion 35 which is configured to be rotatable when a matching key is received in a keyway 36. Rotation of the engagement portion may be used to control various functions of the mortise lock, which will be described in detail with reference to FIGS. 4-9. Of course, while one embodiment of a lock cylinder and engagement portion is shown in FIGS. 3-9, any suitable lock cylinder or locking device may be employed with the mortise lock, as the present disclosure is not so limited.

Figure 5:
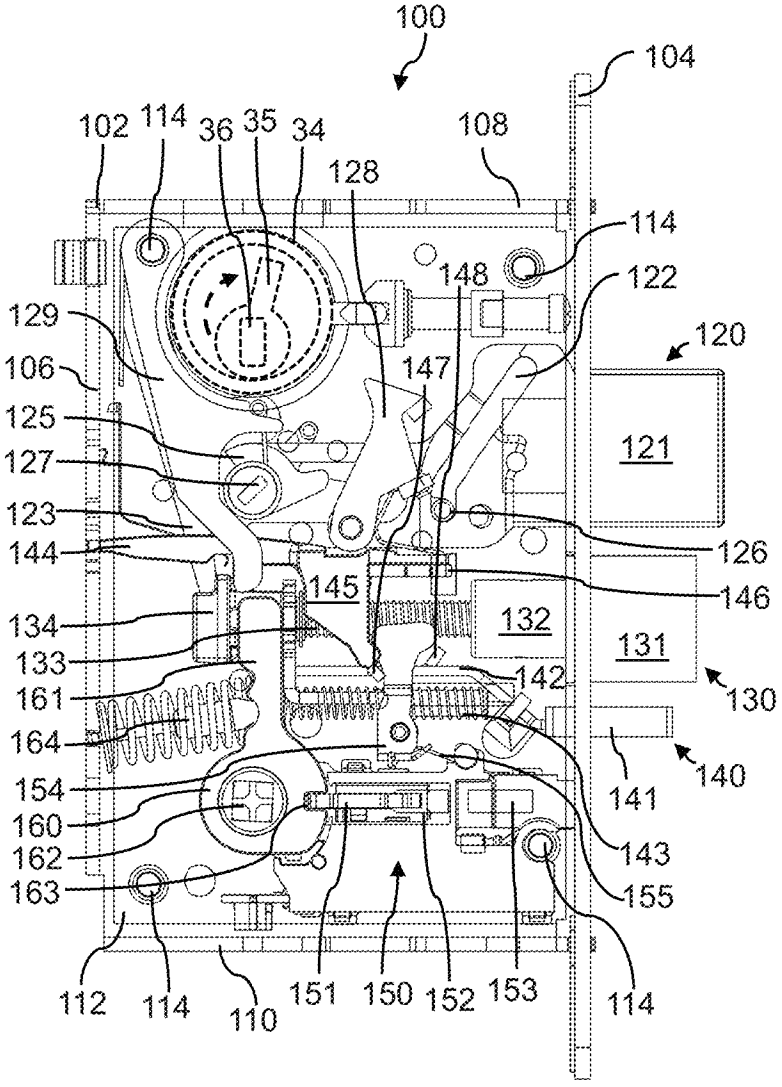
FIG. 5 is a front view of the mortise lock of FIG. 4.
Figure 4:
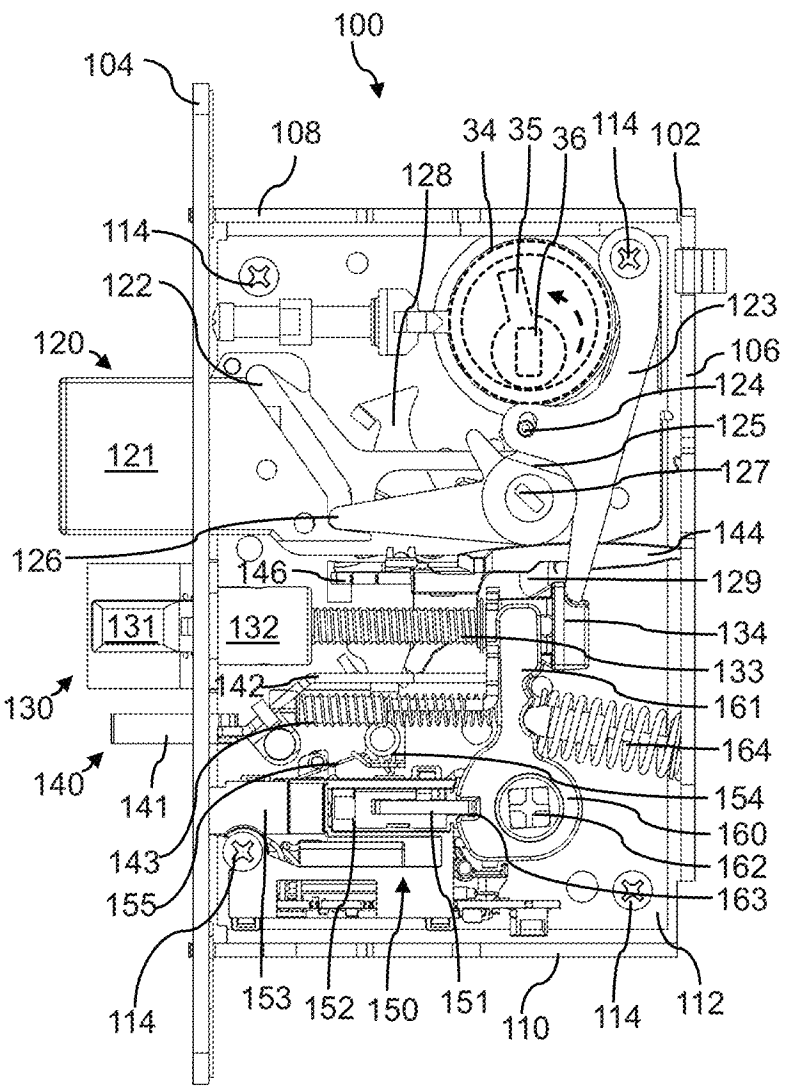
FIG. 4 is a rear view of the mortise lock of FIG. 3 in a latched and bolted state.

FIGS. 4-5 depict a rear view and front view, respectively, of the mortise lock 100 for a multi-point latching device of FIG. 3 which includes a chassis or housing 102 having front plate 104, rear plate 106, top plate 108, bottom plate 110, and side plates 112 (one side plate is omitted from FIGS. 4-5 to expose internal components of the mortise lock 100, and one side plate 112 is shown transparently for clarity). Front plate 104 may have holes through which screws or bolts may be used for securing or fastening the mortise lock 100 to a door. For example, there may be two holes, one at a top of front plate 104 and another at a bottom of front plate 104, or there may be more or fewer holes. Other suitable devices for securing or fastening the mortise lock 100 to a door may also be used as the disclosure is not limited in this respect. Front plate 104 further includes openings for one or more of deadbolt 120, latch bolt 130, auxiliary bolt 140, and handle lock 150. Chassis 102 may be secured together by screws 114 passing through side plates 112. For example, four screws, one at each corner of side plates 112, may be used, or more or fewer screws or other fastening devices or methods in other suitable arrangements. Chassis 102 may be formed out of one or more pieces. For example, in some embodiments, rear plate 106, top plate 108, bottom plate 110, and one of side plates 112 may be formed as a single integral piece of material (e.g., metal, plastic, or some other material or combination of materials) that is secured or fastened to front plate 104 or the opposing one of side plates 112 or both by, e.g., screws, bolts, rivets, snap or press fit, welding, or some other fastening device or method or combination of fastening devices or methods. In some embodiments, chassis 102 may include one or more slots in either or both of side plates 112 to facilitate moving or sliding pieces inside of the mortise lock.

As shown in FIGS. 4-5, deadbolt 120 includes deadbolt head 121, a deadbolt arm 125, and a deadbolt backstop 123. Deadbolt head 121 protrudes from chassis 102 and front plate 104 when deadbolt 120 is in the extended deadbolt position and is within or substantially within a profile of the chassis 102 when deadbolt 120 is in the retracted deadbolt position. In some embodiments, deadbolt head 121 is a solid piece of metal. Deadbolt 120 also includes a slide mechanism extending from the deadbolt head 121 and including one or more cam slots 122. Deadbolt 120 also includes deadbolt arm 125 rotatably mounted within the chassis 102. Deadbolt arm 125 has a protrusion 126 that extends into the cam slot 122 of slide mechanism and a thumb turn 127 about which the deadbolt arm 125 rotates. When thumb turn 127 is turned, for example by an operator operating a knob or key engaging the thumb turn slot, the protrusion 126 of the deadbolt arm 125 contacts an edge of the cam slot 122 in the slide mechanism in a camming fashion which causes the deadbolt 120 to move relative to the chassis 102 between a retracted position and an extended position (see FIGS. 4-7). In one embodiment, the cam slot 122 in the slide mechanism is angled at a lower portion thereof such that, when the deadbolt 120 is in the extended position (as shown in FIGS. 4-5), the deadbolt 120 is prevented from moving relative to the chassis 102 as the deadbolt arm 125 is aligned with the deadbolt head 121 and a retracting force on the deadbolt head will simply cause the lower portion of the slot 122 to bear against the protrusion of the deadbolt arm 125 without rotating the deadbolt arm.

According to the embodiment shown in FIGS. 4-5, the deadbolt arm 125 is coupled to a deadbolt backstop 123 by a peg 124 on deadbolt arm 125 which is inserted through an opening or hole in backstop 123. Backstop 123 is configured to pivot about the screw 114 in the upper, right-hand side of the chassis 102 as shown in FIG. 4. The deadbolt backstop is employed to selectively couple the movement of the deadbolt and the latch bolt, as will be described further below.

Latch bolt 130 includes latch bolt head 131 and latch bolt cylinder 132. Latch bolt head 131 protrudes from chassis 102 and front plate 104 when latch bolt 130 is in the extended position and is within or substantially within a profile of the chassis 102 when latch bolt 130 is in the retracted position. A latch biasing member 133 is surrounds a rod extending from the cylinder 132 and urges the latch bolt 130 to remain in the extended latch position. As shown in FIGS. 4-5, the mortise lock 100 also includes a lever hub 160 with two aligned latch arms 161 coupled to the latch bolt 130, a lever spring 164, and two aligned holes 162. For example, a square shaft of a door handle may be inserted into each of the holes 162, so that an inside door handle and an outside door handle are coupled to each respective hole. The latch arms 161 are configured to move independently as the lever hub 160 rotates about an axis defined by the center of holes 162 between an open and a closed position, with lever spring 164 biasing them to their closed position as shown in FIGS. 4-5. Rotation of a door handle disposed in one of the holes 162 will cause the corresponding latch arm 161 to move to its open position, engaging a latch bolt end 134 of the rod extending from the latch bolt cylinder 132, thereby causing latch bolt 130 to move to its retracted position.

As shown in FIGS. 4-5, the deadbolt 120 is coupled to the latch bolt 130 and the lever hub 160 so that if deadbolt 120 is in its extended position, moving the latch arm 161 to its open position will cause deadbolt 120 to move to its deadbolt retracted position. In particular, the deadbolt backstop 123 contacts the latch bolt end 134 located at the end of the rod extending from the latch bolt cylinder 132 when the deadbolt 120 is in the extended position. When one of the latch arms 161 is rotated (e.g., via a door handle coupled to the corresponding opening 162), the latch bolt end 134 is moved, which in turn contacts the deadbolt backstop 123 and pivots the deadbolt backstop, thereby rotating the deadbolt arm 125 via peg 124 to retract the deadbolt head 121.

As shown in FIGS. 4-5, the mortise lock 100 also includes a guard lever 144 having a guard lever lower leg 145. According to the depicted embodiment, the guard lever 144 is supported in chassis 102 by an end the guard lever being attached to rear plate 106. Guard lever 144 pivots relative to chassis 102 about the end of the guard lever supported in the rear plate 106, between an upper or free position and a lower or secure position. When guard lever 144 is in its secure position, a blocking end 146 of guard lever 144 acts to prevent latch bolt 130 from moving to its retracted position by contacting the latch bolt cylinder 132 and thereby blocking further retraction of the latch bolt 130.

According to the embodiment shown in FIGS. 4-5, the mortise lock includes an auxiliary bolt 140 having a tongue 141 and auxiliary arm 142. Auxiliary bolt tongue 141 protrudes from chassis 102 and front plate 104 when auxiliary bolt 140 is in the extended auxiliary position and is within or substantially within a profile of the chassis 102 when auxiliary bolt 140 is in the retracted auxiliary position. Auxiliary bolt spring 143 is coupled with arm 142 and urges the auxiliary bolt 140 to remain in the extended position. The auxiliary bolt arm 142 includes a first tab 147 and a second tab 148. As shown in FIGS. 4-5, when auxiliary bolt 140 is in the extended position, the at least one tab 147 acts to prop up guard lever 144 by engaging its lower leg 145 to maintain guard lever 144 in its free position (i.e., allowing latch bolt 130 to move freely between its extended and retracted positions). When auxiliary bolt 140 is retracted, the first tab 147 is disengaged from the guard lever lower leg 145 and the auxiliary arm 142 and/or second tab 148 engages lower leg 145, thereby moving the guard lever 144 to its secure position, thereby blocking latch bolt 130 from moving to its retracted position. In some embodiments, when latch bolt 130 is moved to its retracted position, latch bolt cylinder 132 makes contact with the second tab 148 of auxiliary bolt arm 142, causing auxiliary bolt 140 to also move to its retracted position (see FIGS. 8-9).

In some embodiments, the guard lever 144 may include a guard biasing member (not shown in the figure) that urges the guard lever 144 toward either the secure or the free position. In one such arrangement, the guard lever 144 may include a spring that biases the guard member toward the secure position. In this embodiment, the first tab may prevent the downward movement of the guard lever 144 (i.e., toward the secure position) by engaging the guard lever and forcing the guard lever up (i.e., toward the free position). Accordingly, when the auxiliary bolt 140 retracts and the first tab 147 disengages with the guard lever 144, the guard lever may be urged by the guard biasing member to the secure position. In another embodiment, the guard lever 144 may be urged upwards by the guard biasing member toward the free position, and the auxiliary arm 142 may be configured to engage the guard lever lower leg 145 and move the guard leg down (i.e., toward the secure position) when the auxiliary bolt is retracted. While some embodiments of the mortise lock 100 include a guard biasing member, it can be appreciated that any suitable arrangement whereby the guard lever may be moved between a free and a secure position may be employed.

As shown in FIGS. 4-5, the mortise lock 100 includes a handle lock mechanism 150 which further includes a first handle lock arm 151, second handle lock arm 152, and a handle lock actuator 153. The handle lock 150 has a locked position and an unlocked position in which at least one of the lever hubs 160 are secured and prevented from rotating, thereby preventing rotation of an associated handle. As shown in FIGS. 4-5, the lever hubs 160 include a notch 163 that is engaged by the first handle lock arm 151 when the handle lock 150 is in its locked position, as shown in FIGS. 4-7. Accordingly, in these depicted states, at least one of the handles associated with the lever hubs will be prevented from moving. Accordingly, an associated cassette which may enable multi-point latching may not be actuable to retract one or more rod actuated latches. In some embodiments, only the exterior door handle will be prevented from opening the door while the interior door handle remains unaffected. According to the embodiment depicted in FIGS. 4-5, when handle lock 150 moves to its unlocked position, the first handle lock arm 151 disengages from notch 163 (see FIGS. 8-9), thereby allowing the lever hubs 160 to move. In this embodiment, the actuator 153 applies a force to the second handle lock arm 152 which is mechanically coupled to the first handle lock arm to slide the first handle lock arm in and out of the notch 163. In some embodiments, the actuator is configured as DC motor which is powered by a combination of wall power and a capacitor. As will be discussed further below, the handle lock is also mechanically coupled to the lock cylinder 34 so that the handle lock may be moved between the locked and unlocked positions without interference or operation of the actuator 153 (e.g., in power failure modes).

According to the embodiment shown in FIGS. 4-5, the mortise lock 100 includes a lock cylinder 34 which is operable with an authenticated key to perform one or more functions of the mortise lock, such as retracting or extending the deadbolt 120 or latch bolt 130, as well as changing the state of the handle lock 150 from a locked position to an unlocked position. That is, all of the major functions of the mortise lock whether they are normally electromechanically controlled or mechanically controlled may be independently controlled with the key cylinder. Such an arrangement is particular beneficial in power failure states, where various features of the door may otherwise be inoperable if one or more electronic actuators are without power, as the mortise lock and any associated multi-point latches may be used normally as purely mechanical locks. Accordingly, as shown in the embodiment of FIGS. 4-5 the lock cylinder includes an engagement portion 35 and a keyway 36. The engagement portion is configured to rotated 360 degrees by a key when a correct (i.e., matching, authenticated) key is received in the keyway. In the state shown in FIGS. 4-5, where the deadbolt is in the deadbolt engaged position, the lock cylinder may be rotated in a direction shown by the arrows to engage the deadbolt arm and move the deadbolt to the deadbolt retracted position. As shown in FIGS. 4-5, the mortise lock also includes a lock cylinder arm 128 and a lock cylinder backstop 129. The lock cylinder arm 128 adjoins the deadbolt 120 and is configured to at least partially couple motion of the lock cylinder to the lock cylinder backstop. Similarly, the lock cylinder backstop 129 is configured to engage the lock cylinder arm and the latch bolt end 134 to couple motion of the lock cylinder to the latch bolt. The mortise lock also includes a handle lock switch 154 which is configured to engage the latch bolt and the first handle lock arm to couple motion of the latch bolt to movement of the handle lock between a locked position and an unlocked position. The interaction between the lock cylinder, deadbolt, lock cylinder arm, lock cylinder back stop, latch bolt, handle lock switch, and handle lock will be described further with reference to FIGS. 6-9.

Figure 7:
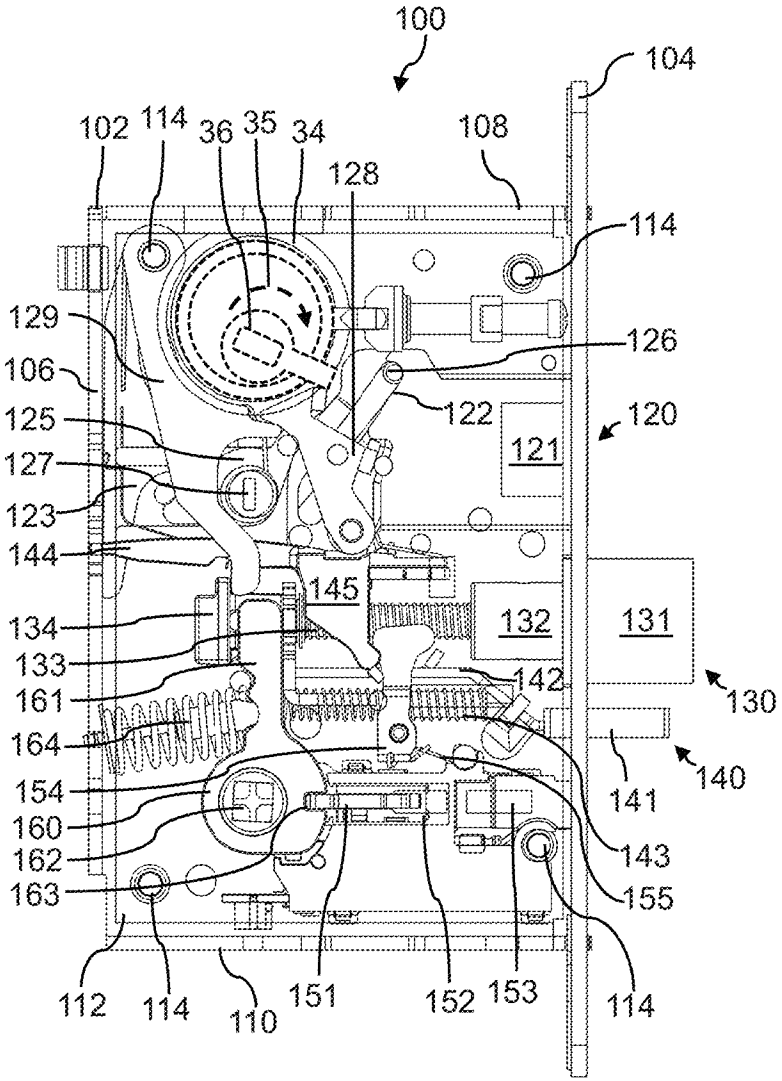
FIG. 7 is a front view of the mortise lock of FIG. 6.
Figure 6:
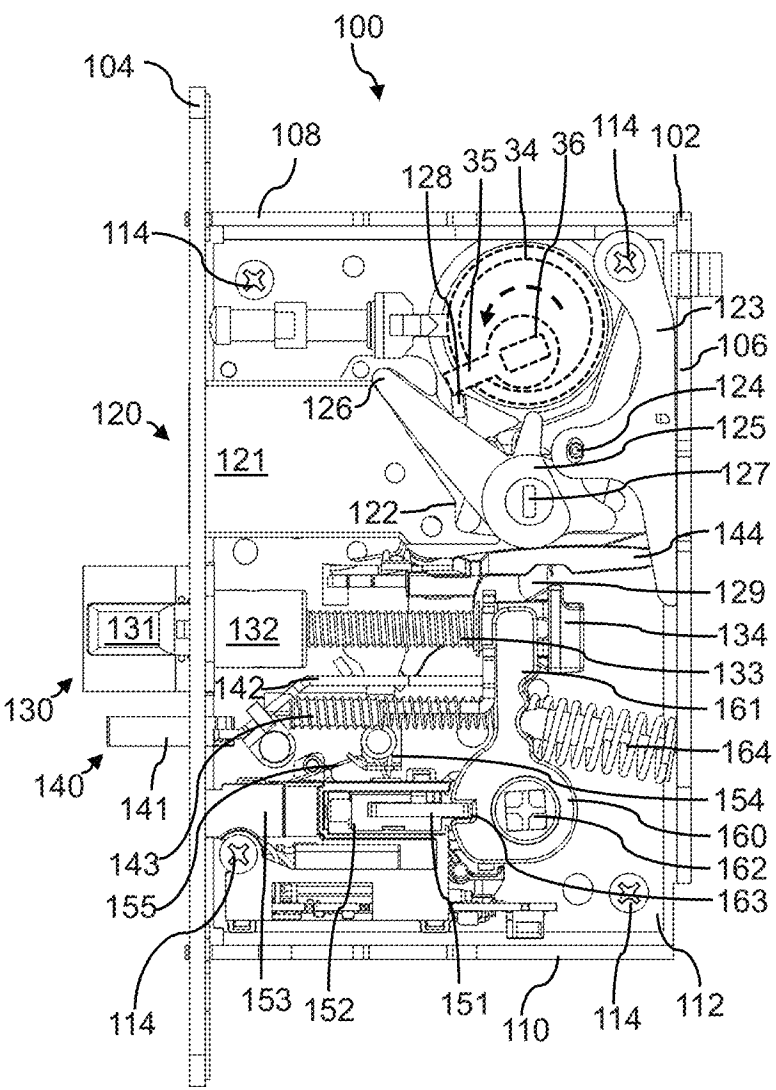
FIG. 6 is a rear view of the mortise lock of FIG. 3 in a latched and unbolted state.

FIGS. 6-7 are a rear and front view, respectively, of the mortise lock of FIG. 3 in a latched and unbolted state (i.e., deadbolt 120 is in the deadbolt retracted position and latch bolt 130 is in the latch extended position). As shown in FIGS. 6-7 the deadbolt has been retracted relative to the state shown in FIGS. 4-5 using the lock cylinder 34. That is, the lock cylinder was rotated in the direction shown by the dashed arrow to engage the deadbolt arm 125 and retract the deadbolt 120. Once the deadbolt was in the retracted position, the lock cylinder was rotated further in the same direction past 360 degrees (i.e., a full rotation) until the engagement portion 35 came into contact with the lock cylinder arm 128 as shown in FIGS. 6-7. The lock cylinder arm 128 abuts the deadbolt and was rotated in the same direction as the deadbolt arm 125 as the deadbolt was retracted. When the deadbolt is in the deadbolt retracted position, the lock cylinder arm comes into abutment with the lock cylinder backstop, so that an interference chain is created between the engagement portion 35, the lock cylinder arm 128, and the lock cylinder backstop 129 in the state shown in FIGS. 6-7. As shown best in FIG. 7, when the lock cylinder is rotated in the direction of the dashed arrow (i.e., clockwise relative to the page), the lock cylinder arm is rotated in an opposite direction (i.e., counterclockwise relative to the page) and transfers the motion to the lock cylinder backstop, which is rotated in the same direction as the engagement portion about screw 114 (i.e., clockwise relative to the page). Thus, when the deadbolt is in the retracted position, the lock cylinder may then be used to move the lock cylinder arm and the lock cylinder backstop. Conversely, in some embodiments, when the deadbolt is in the extended position, the lock cylinder arm may only be used to retract the deadbolt with a full rotation of the lock cylinder.

According to the embodiment shown in FIGS. 6-7, the motion of the lock cylinder engagement portion 35 in the direction indicated by the dashed arrows is coupled to the latch bolt 130 when the deadbolt 120 in the deadbolt retracted position. That is, the lock cylinder backstop 129 contacts the latch bolt end 134 on an opposite side of that of the deadbolt backstop 123. Accordingly, where the deadbolt backstop was used to transfer motion of the latch bolt to the deadbolt, the lock cylinder backstop is used to transfer motion of the lock cylinder to the latch bolt. When the lock cylinder engagement portion is rotated in the direction shown (i.e., the same direction used to move the deadbolt to the retracted position), the latch bolt is moved to toward the latch retracted position by the movement of the lock cylinder backstop. This movement of the lock cylinder may be against the biasing force of the latch bolt biasing member 133, meaning an operator may resist the biasing force as the lock cylinder is used to retract the latch bolt.

According to the embodiment of FIGS. 6-7 and shown clearly in FIG. 7, the handle lock switch 154 is configured to couple motion of the latch bolt 130 to movement of the handle lock between the locked and unlocked positions. In particular, the handle lock switch is configured to pivot and is biased to the position shown in FIGS. 6-7 by a handle lock switch biasing member 155 configured as torsion spring in the present embodiment, although any suitable biasing member may be employed. The handle lock switch projects on one end into the path of the latch bolt cylinder 132 when the latch bolt cylinder is moved to the latch retracted position. On the other end, the handle lock switch is coupled to the first handle lock arm 151 so that rotational motion of the handle lock switch causes sliding motion of the first handle lock arm between the locked position and the unlocked position. Accordingly, when the latch bolt 130 is retracted, the latch bolt cylinder contacts the handle lock switch and causes the handle lock switch to rotate in the same direction as the lock cylinder arm (i.e., counterclockwise relative to page with reference to FIG. 7). As the handle lock switch rotates, the first handle arm is moved out of the notch 163 formed in at least one of the lever hubs 160 and the handle lock is correspondingly in an unlocked position. Accordingly, the operator may hold the lock cylinder engagement portion 35 in a position when the deadbolt is retracted, the latch bolt is retracted, and the handle lock is in an unlocked position to allow the lever hubs 160 and associated handles to be rotated. Allowing such rotation allows one or more rod actuated latches (e.g., actuated by a cassette coupled to the associated handles) to be retracted and an associated door opened.

Figure 9:
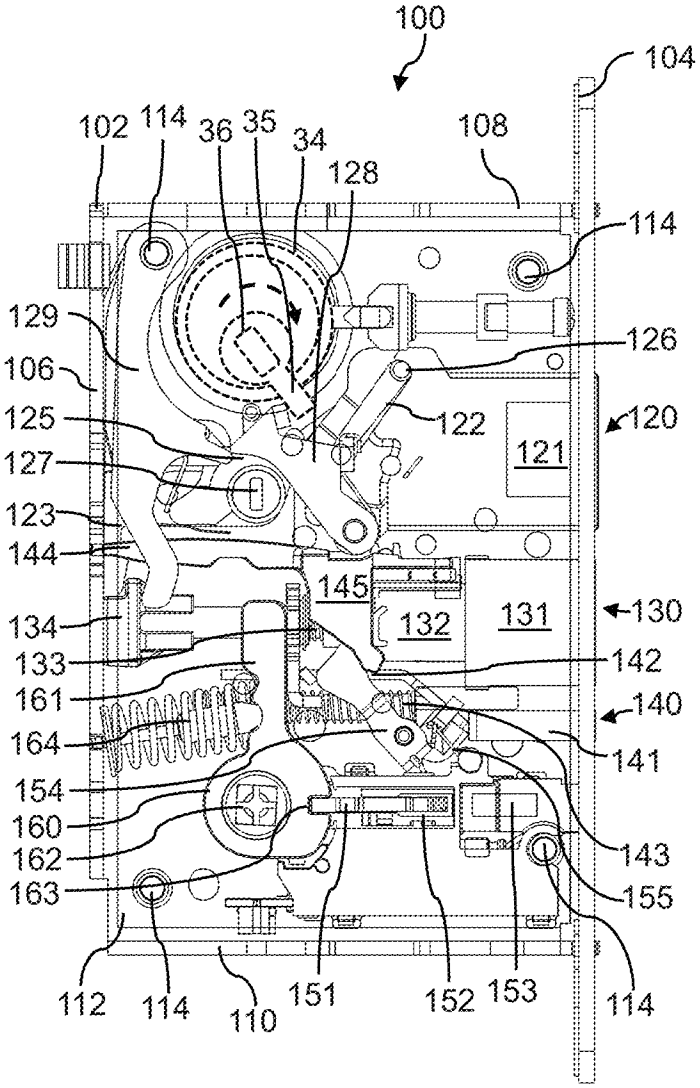
FIG. 9 is a front view of the mortise lock of FIG. 8.
Figure 8:
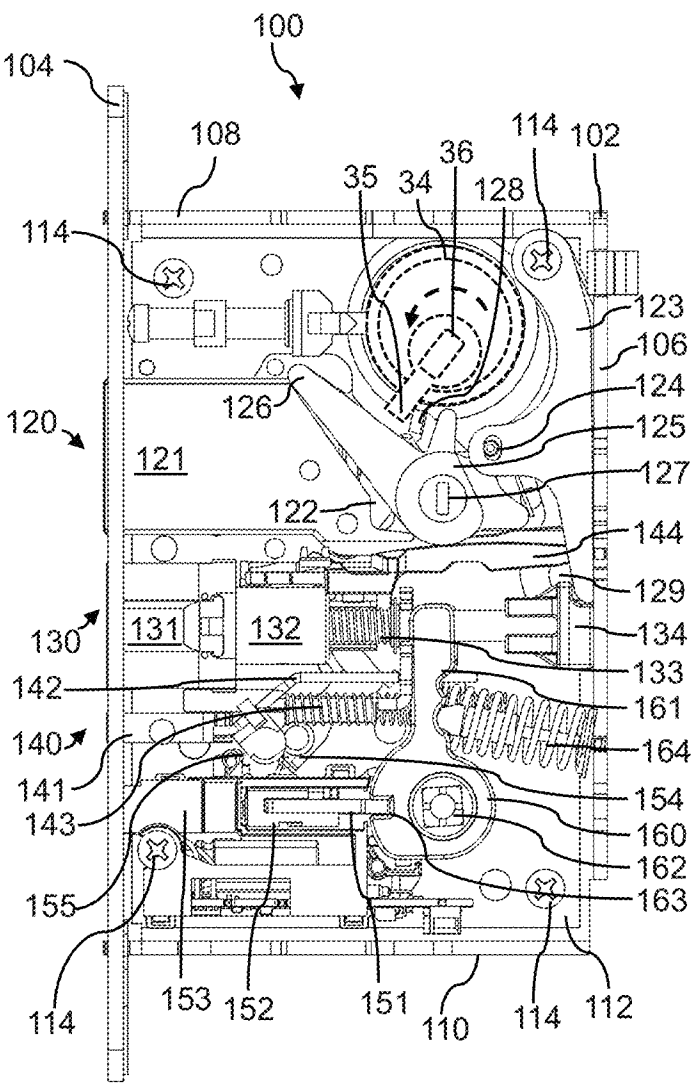
FIG. 8 is a rear view of the mortise lock of FIG. 3 in an unlatched and unbolted state.

FIGS. 8-9 are a rear and front view, respectively, of the mortise lock of FIG. 3 in an unlatched and unbolted state (i.e., deadbolt 120 is in the deadbolt retracted position and latch bolt 130 is in the latch retracted position). According to the state shown in FIGS. 8-9, the deadbolt and latch bolt have been moved to retracted positions and the lock cylinder engagement portion 35 is being held against the biasing force of the latch bolt biasing member 133 to maintain the handle lock 150 in the unlocked position so that a handle may be operated to retract one or more rod actuated latched (e.g., via a cassette). That is, as discussed previously, the lock cylinder was rotated in the direction shown in the dashed arrows to retract the deadbolt 120 (see FIGS. 4-5) and subsequently retract the latch (see FIGS. 6-7). As shown in FIGS. 8-9, the engagement portion 35 of the lock cylinder 34 is bearing against the lock cylinder arm 128, causing the lock cylinder backstop 129 to contact the latch bolt end 134 and maintain the latch bolt in the latch retracted position against the biasing force of the latch biasing member 133. The latch bolt cylinder 132 has contacted and pivots the handle lock switch 154 against the biasing force from the handle lock switch biasing member 155. Correspondingly, the first handle lock arm 151 and second handle lock arm 152 have been moved (i.e., slid) out of the notch 163 formed in at least one of the lever hubs 160. Accordingly, any handles disposed in the holes 162 formed in the lever hubs may be freely rotated. This rotation may allow one or more rod actuated latches (e.g., a top latch and bottom latch) or otherwise remote latches (e.g., cable operated latches, chain operated latches, etc.) to be operated with the handle so that a multi-point latching device including the mortise lock 100 may be opened if the handle lock actuator 153 is inoperable due to power failure or some other condition.

From the position shown in FIGS. 8-9, the various components of the mortise lock 100 are biased such that he mortise lock may automatically revert to a secure position with at least the latch bolt 130 moving to an extended position when the lock cylinder engagement portion 35 is released. That is, according to the present embodiment, unless force (i.e., torque) is actively applied to the lock cylinder engagement portion in the direction shown by the dashed arrows, the biasing members may urge the lock cylinder engagement portion in an opposite direction until at least the latch bolt is extended and the handle lock is in the locked position. Simply put, the latch bolt biasing member 134, handle lock switch biasing member 155, and other associated biasing members may urge the mortise lock to a secured position when the lock cylinder is not being actively used by an operator. Accordingly, the mortise lock may automatically return to the position shown in FIGS. 6-7 if force is removed from the lock cylinder engagement portion 35 in the state of FIGS. 8-9. Of course, any suitable biasing arrangement may be employed, and the mortise lock may be biased to return to any suitable state or remain unbiased, as the present disclosure is not so limited. Additionally, the motion of the lock cylinder may be reversed from the direction shown in the dashed arrows (i.e., moved in a second direction) to reverse the mortise lock to the state shown in FIGS. 4-5, extending both the latch bolt and the deadbolt. Thus, the lock cylinder may be employed to move the mortise lock to any secured or unsecured state, including a state where an associated handle is operable to retract one or more remote latches.

Figure 10:
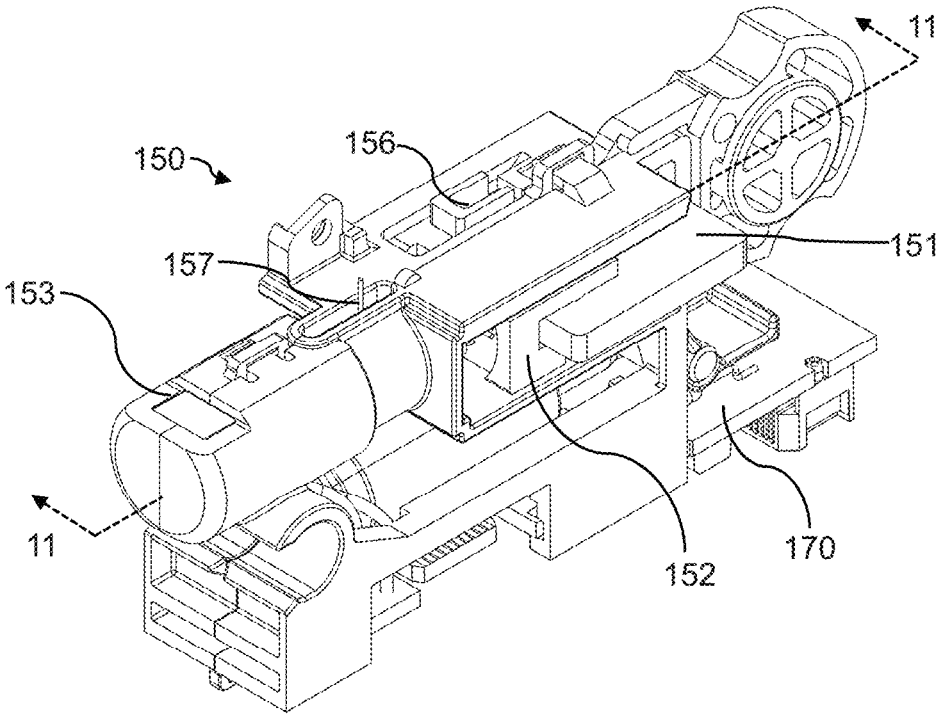
FIG. 10 is a perspective view of one embodiment of a handle lock.
Figure 11:
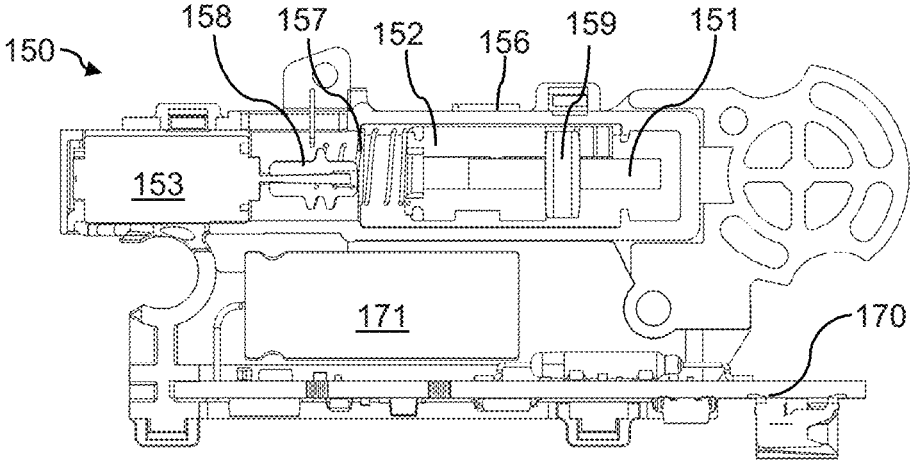
FIG. 11 is a cross sectional view of the handle lock of FIG. 10 taken along line 11-11.

FIG. 10 is a perspective view of one embodiment of a handle lock 150 showing how the handle lock is independently operable by both an electromechanical actuator 153 and mechanically via a lock cylinder (see FIGS. 4-9). FIG. 11 is a cross sectional view of the handle lock actuator 150 taken along line 11-11 of FIG. 10 showing the mechanical interaction between the various components. As shown in FIGS. 10-11, the handle lock includes a first handle arm 151 and a second handle arm 152, which according to this embodiment are directly coupled to one another with a handle lock arm pin 159. This pin arrangement allows the first handle arm to be easily flipped that the first handle arm projects in to a selected side of a door (e.g., exterior side) for either left hand or right hand installations. Accordingly, the first handle lock arm and second handle lock arm slide together to move into and out of a notch formed in a lever hub. The handle lock also includes a motor 153 which includes a screw 158 configured to engage a coil spring 157. As best shown in FIG. 11, the coil spring links the actuator to the second handle lock arm 152, such that rotation of the screw 158 causes linear motion of the first and second handle lock arms as the coil spring is threaded on or off the screw. The handle lock also includes a handle lock switch engagement portion 156 which is configured to receive pivoting motion from a handle lock switch (see FIGS. 4-9) which slides the first and second handle lock arms. According to the embodiment of FIGS. 10-11, the coil spring 157 compresses to allow the first and second handle lock arms to move under force from a handle lock switch, without movement of the actuator. Thus, the first and second handle lock arms may be independently actuated by either the actuator 153 or manually via a lock switch arm or other mechanical feature linked to a lock cylinder or other manual device.

As shown in FIGS. 10-11, the actuator may be controlled by a control circuit 170 and powered at least in part by a capacitor 171. The control circuit may be configured to receive remote commands (e.g., from a sever, mobile device, personal computer, etc.) or local commands (e.g., from a card reader, key pad, biometric authenticator, radio transceiver, etc.) to activate the actuate to move the handle lock arms between a lock position when they prevent rotation of a handle or an unlocked position where they allow rotation of a handle. During typical operation, the control circuit may receive constant power from a wall source via a power connector or other suitable interface. In power failure modes, power stored in the capacitor may be used to perform a final state change for the handle lock. That is, the capacitor may be used to power the actuator to move the handle lock according to a fail safe condition (i.e., handle locked position) or a fail secure condition (i.e., handle unlocked position). According to exemplary embodiments herein, the actuator may move the handle lock to a handle locked position (i.e., fail secure condition) without preventing an authenticated operator from opening a door. That is, an authenticated operator may use manual authentication (e.g., a lock cylinder with key) to open a multi-point latching device including the handle lock of FIGS. 10-11. Of course, a handle lock may use any appropriate configuration to allow a handle lock to be moved between locked positions and unlocked positions with an electromechanical actuator and a manual element, as the present disclosure is not so limited.

In some embodiments, a method for operating a multi-point latching device includes moving a handle lock between a locked position and an unlocked position with an actuator. For example, the actuator may be configured as a motor turning a screw to slide a handle lock arm in or out of a notch formed in a lever hub. The method may also include rotating a lock cylinder in a first direction to move a latch bolt from a latch extended position to a latch retracted position. For example, the lock cylinder may engage a lock cylinder arm and a lock cylinder backstop which allows the rotational motion of the lock cylinder to be transmitted to linear motion of the latch bolt towards the retracted position. In some embodiments, the latch cylinder may be used first to move a deadbolt from an extended deadbolt position to a retracted deadbolt position by rotating the lock cylinder in the first direction. That is, in some embodiments, the latch cylinder may not be used to retract the latch bolt until the deadbolt is retracted. The method may also include rotating the lock cylinder in the first direction to move the handle lock from a locked position to an unlocked position. For example, retracting the latch bolt may contact a handle lock switch which moves a handle lock arm out of a notch formed in a lever hub. Retracting the latch bolt and unlocking the handle lock may include resisting a biasing force from the latch bolt and/or a handle lock switch. That is, the latch bolt may be urged toward the extended position and the handle lock to the locked position if constant force is not applied to the lock cylinder by an operator to maintain the latch bolt in the retracted state and the handle lock in the unlocked position. When the handle lock is in the unlocked position, the method may include rotating a handle associated with the handle lock to retract one or more remote latches (e.g., rod actuated latches such as top latches or bottom latches) so that a door secured by the multi-point latching device may be opened. Thus, according to this method, the handle lock may be moved to an unlocked position and a multi-point latching device unlatched so a door may be opened without the movement of the actuator.

In some embodiments, doors secured with multi-point latching devices according to exemplary embodiments described herein may be suitable for use in high wind areas. For example, a door secured by the multi-point latching device of FIGS. 1-2 may withstand a first impact from a 6.8 kg 2×4 piece of lumber traveling at a speed between 80 mph and 100 mph near the transom latch. The same secured door may then subsequently withstand a subsequent second impact from a 6.8 kg 2×4 piece of lumber traveling at a speed between 80 mph and 100 mph near the mortise lock. Finally, the same secured door may subsequently withstand a subsequent third impact from 6.8 kg 2×4 piece of lumber traveling at a speed between 80 mph and 100 mph near a hinge interface of the door. In cases where a pair of doors is employed and at least one is secured with an multi-point latching device according to exemplary embodiments disclosed herein, the secured door may withstand a subsequent fourth impact from a 6.8 kg 2×4 piece of lumber traveling at a speed between 80 mph and 100 mph near a mullion interface between the two doors. Additionally, a door secured by a multi-point latching device of exemplary embodiments described herein may withstand positive or negative pressure as a result of wind speeds between 130 and 250 mph. Withstanding the above noted impacts or pressures may be determined at least partially by measuring perforation of a witness screen placed proximate the door. That is, a door withstands impact or pressure when a #70 unbleached kraft paper witness screen with its surface secured in place on a rigid frame installed within 5 inches of the interior surface of the door remains unperforated after the impact or pressure. Furthermore, a door may withstand impact or pressure when permanent deformation of the door measured from a straight edge held between two undeformed points on the door is less than or equal to 3 inches. Of course, doors secured by the multi-point latching devices of embodiments described herein may meet any suitable standards for use in high wind areas, storm shelters, etc., including, but not limited to ICC 500, FEMA P361, FEMA P320, or any other modern or updated testing standard, as the present disclosure is not so limited.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A latching device comprising:

a chassis;

a latch bolt configured to move between a latch extended position and a latch retracted position;

a deadbolt configured to move between a deadbolt extended position and a deadbolt retracted position;

a handle lock configured to selectively lock a handle in a locked position and unlock the handle in an unlocked position;

an electromechanical actuator configured to move the handle lock between the locked position and the unlocked position; and a lock cylinder configured to receive a key, wherein the lock cylinder is further configured to rotate, wherein in a first rotation of the lock cylinder in a first direction the deadbolt is moved from the deadbolt extended position to the deadbolt retracted position and in a second rotation of the lock cylinder in the first direction the latch bolt is moved from the latch extended position to the latch retracted position and the handle lock is moved from the locked position to the unlocked position, wherein moving the latch bolt from the latch extended position to the latch retracted position by rotation of the lock cylinder moves the handle lock from the locked position to the unlocked position, and wherein the lock cylinder is configured to override the locked position caused by the electromechanical actuator upon a power loss to the electromechanical actuator.

2. The latching device of claim 1, wherein the first rotation is a 360 degree rotation.

3. The latching device of claim 1, wherein the second rotation is less than 360 degrees.

4. The latching device of claim 1, wherein the electromechanical actuator is powered by at least one capacitor.

5. The latching device of claim 1, wherein the handle lock is biased toward the locked position, wherein the lock cylinder is configured to be held by an operator to retain the handle lock in the unlocked position.

6. The latching device of claim 1, wherein the lock cylinder and the electromechanical actuator are independently operable to move the handle lock from the locked position to the unlocked position.

7. The latching device of claim 1, further comprising at least one rod actuated latch coupled to the handle, wherein when the handle is rotated the at least one rod actuated latch moves from a rod actuated extended position to a rod actuated retracted position, and wherein the handle lock is configured to prevent rotation of the handle in the locked position and permit rotation of the handle in the unlocked position.

8. The latching device of claim 1, further comprising a handle lock switch configured to engage the latch bolt and the handle lock, wherein the handle lock switch couples movement of the latch bolt to movement of the handle lock between the locked position and the unlocked position.

9. The latching device of claim 8, wherein moving the latch bolt from the latch extended position to the latch retracted position moves the handle lock switch to move the handle lock from the locked position to the unlocked position.

10. A latching device comprising:

a chassis;

a latch bolt configured to move between a latch extended position and a latch retracted position;

a deadbolt configured to move between a deadbolt extended position and a deadbolt retracted position;

a handle lock configured to selectively lock a handle in a locked position and unlock the handle in an unlocked position;

an electromechanical actuator configured to move the handle lock between the locked position and the unlocked position; and a lock cylinder configured to receive a key, wherein the lock cylinder is further configured to rotate, wherein in a first rotation of the lock cylinder in a first direction the deadbolt is moved from the deadbolt extended position to the deadbolt retracted position and in a second rotation of the lock cylinder in the first direction the latch bolt is moved from the latch extended position to the latch retracted position and the handle lock is moved from the locked position to the unlocked position.

11. The latching device of claim 10, wherein the first rotation is a 360 degree rotation.

12. The latching device of claim 10, wherein the second rotation is less than 360 degrees.

* * * * *